US008955441B2

(12) United States Patent
Schlenter

(10) Patent No.: US 8,955,441 B2
(45) Date of Patent: Feb. 17, 2015

(54) DENTONATOR CROSS-TALK REDUCTION

(75) Inventor: Craig Charles Schlenter, Sandton (ZA)

(73) Assignee: Detnet South Africa (Pty) Limited (ZA)

( * ) Notice: Subject to any disclaimer, the term of this patent is extended or adjusted under 35 U.S.C. 154(b) by 1157 days.

(21) Appl. No.: 12/303,782

(22) PCT Filed: May 21, 2007

(86) PCT No.: PCT/ZA2007/000027

§ 371 (c)(1),
(2), (4) Date: Dec. 8, 2008

(87) PCT Pub. No.: WO2007/143759

PCT Pub. Date: Dec. 13, 2007

(65) Prior Publication Data

US 2010/0288149 A1 Nov. 18, 2010

(30) Foreign Application Priority Data

Jun. 9, 2006 (ZA) ..... 2006/04731

(51) Int. Cl.
*F42D 1/055* (2006.01)

(52) U.S. Cl.
CPC ..... *F42D 1/055* (2013.01)
USPC ..... 102/217

(58) Field of Classification Search
USPC ..... 102/217
See application file for complete search history.

(56) References Cited

U.S. PATENT DOCUMENTS

| | | | | |
|---|---|---|---|---|
| 4,477,896 | A * | 10/1984 | Aker | 370/201 |
| 4,825,765 | A * | 5/1989 | Ochi et al. | 102/206 |
| 5,793,318 | A * | 8/1998 | Jewett | 341/118 |
| 6,188,314 | B1 | 2/2001 | Wallace | |
| 7,082,877 | B2 * | 8/2006 | Jennings, III | 102/215 |
| 7,791,858 | B2 * | 9/2010 | Hummel et al. | 361/247 |
| 7,929,270 | B2 * | 4/2011 | Hummel et al. | 361/249 |
| 2005/0011389 | A1 | 1/2005 | Teowee | |
| 2005/0015473 | A1 * | 1/2005 | Teowee et al. | 709/223 |
| 2005/0034623 | A1 * | 2/2005 | Jennings, III | 102/200 |
| 2009/0283004 | A1 * | 11/2009 | Teowee et al. | 102/215 |

FOREIGN PATENT DOCUMENTS

EP 0583716 2/1994

* cited by examiner

*Primary Examiner* — Reginald Tillman, Jr.
(74) *Attorney, Agent, or Firm* — Schmeiser, Olsen & Watts, LLP

(57) ABSTRACT

A detonator system (10) which has a plurality of segments (16), each segment having a respective plurality of detonators (14), and a synchronizer (18, 12), which may be a compound arrangement or a single device, which prevents the transmission of voltage modulated signals to the detonators (14) in one segment (16A) if current modulated segments are being transmitted from the detonators (14) in another segment (16B).

10 Claims, 2 Drawing Sheets

DENTONATOR CROSS-TALK REDUCTION

BACKGROUND OF THE INVENTION

This invention relates to communication cross-talk in detonator systems and particularly in large detonator systems.

Many electronic detonator systems use voltage modulation techniques on signals which are transmitted from a control device to an electronic detonator, and current modulation techniques on signals which are transmitted from a detonator to the control device. A large detonator system can include hundreds, if not thousands, of detonators and electrical constraints usually require that the detonators are split into segments which are electrically isolated from each other. A separate control device is used to control each segment. Each control device is connected to a master blast controller which is used to initiate the blast.

Typically the level of voltage modulation is of the order of several volts while the level of current modulation is of the order of a few milliamperes. Thus if voltage modulated signals are transmitted in one segment and current modulated signals are transmitted in an adjacent segment the level of electronic interference in the current modulated segment may be sufficiently high to disrupt communications.

In one approach which is adopted to address this problem communication is allowed in only one segment at a time in order to eliminate cross-talk between segments. In another approach communication between the controller and the detonators is repeated to ensure that the communication is successful. Each technique increases the time required for successful communication.

The invention is concerned with an alternative approach to reducing detonator cross-talk of the aforementioned kind.

SUMMARY OF THE INVENTION

The invention provides, in the first instance, a detonator system which includes a plurality of segments each of which has a respective plurality of detonators, a controller, a transmitter for transmitting voltage modulated signals from the controller to detonators in each of the segments, a receiver for receiving current modulated signals transmitted from detonators in each of the segments, and a synchroniser which prevents the transmission of the voltage modulated signals in one segment simultaneously with the transmission of the current modulation signals in at least one other segment.

Preferably all the segments are synchronised in the sense that the transmission of voltage modulated signals in any segment does not occur at the same time as the transmission of current modulated signals in any of the other segments.

The synchroniser may be a single device or it may be a compound arrangement made up of a plurality of devices located at different respective positions within the detonator system.

In a first form of the invention the synchroniser includes a master clock located, for example, at the controller or within one of the segments, the clock being operable to ensure that, within each segment, the transition of a period within which voltage modulated signals can be transmitted to a period within which current modulated signals can be transmitted can occur only at a defined time determined by the master clock.

In a second form of the invention the synchroniser comprises a plurality of control devices. Each segment within the detonator system includes a control device which controls the transmission of the voltage modulated signals in the respective segments thereby to ensure that transmission of current modulated signals, on all segments, only takes place when the voltage modulated signals on all segments cease.

In a third approach, which is similar to the second form, each segment includes a control device which communicates with the controller and the controller allocates a time slot, per segment, for the transmission of current modulated signals from that segment to the controller.

In another form of the invention the synchroniser is a compound arrangement. Commands which are transmissible from the controller, i.e. those commands which are embodied in the voltage modulated signals, are identified beforehand and a fixed time slot is allocated for the transmission of the voltage modulated signals, which contain the identified commands, to each of the segments. After the expiry of the time slot the transmission of the current modulated signals is permitted.

In a different form of the invention, also based on a compound synchroniser, the controller includes a plurality of communication channels each of which is associated uniquely with a respective segment. The controller can then, operating in parallel through the channels, communicate with each segment directly and thereafter the detonators in each segment, again transmitting in parallel, can communicate directly with the controller.

The invention also extends to a method of reducing cross-talk in a detonator system which has a plurality of segments each including a plurality of detonators, and a controller for communicating with the detonators, the method including the steps of transmitting first signals, which are voltage modulated, from the controller to detonators at least in first and second segments, receiving second signals, which are current modulated, transmitted by detonators at least in the first and second segments, and synchronising the transmission of the first and second signals so that the first signals are not transmitted to detonators in the first segment while the second signals are being transmitted from detonators in the second segment.

BRIEF DESCRIPTION OF THE DRAWINGS

The invention is further described by way of examples with reference to the accompanying drawings in which.

DESCRIPTION OF PREFERRED EMBODIMENTS

Figure 1:
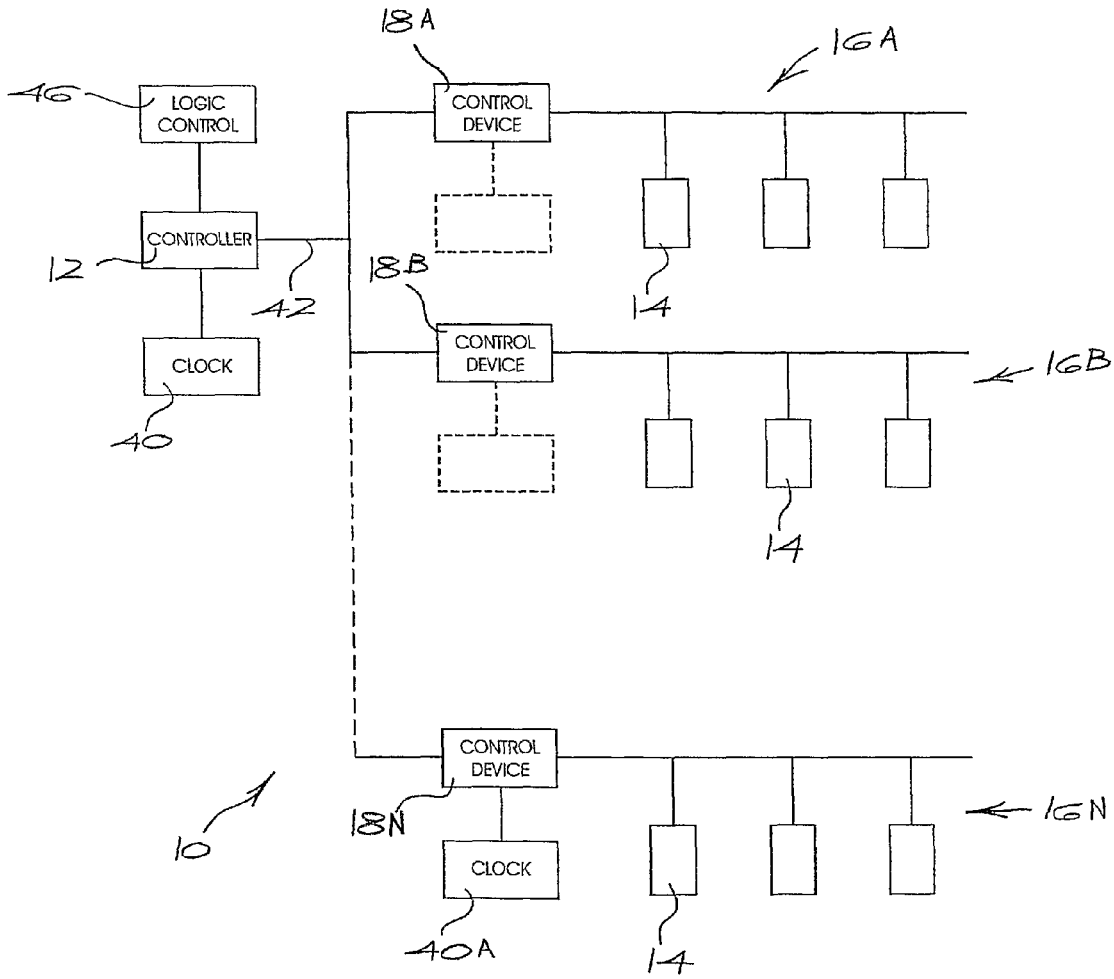
FIG. 1 is a schematic representation of an electronic detonator system in which various techniques for the reduction of detonator cross-talk can be implemented in accordance with the principles of the invention.

FIG. 1 of the accompanying drawings illustrates an electronic detonator system 10 which includes a master controller 12 and a plurality of detonators 14. The detonators are arranged in different segments designated 16A, 16B . . . 16N. This is in accordance with criteria which are known in the art.

A respective control device 18A, 18B . . . 18N is associated with each segment.

Figure 2:
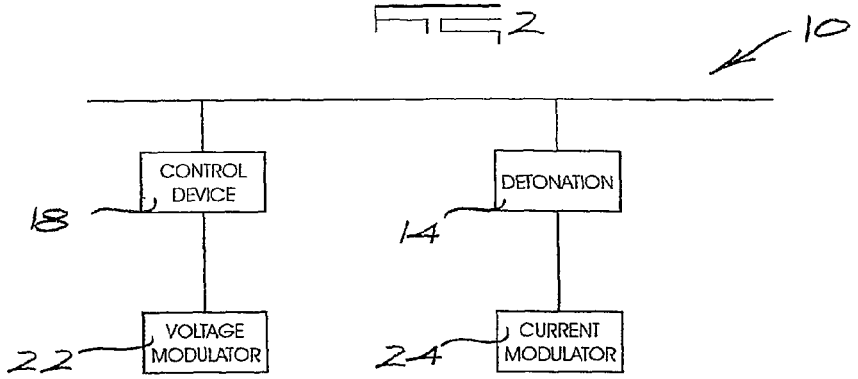
FIG. 2 illustrates a portion of the detonator system of FIG. 1.

FIG. 2 illustrates part of the detonator system 10. FIG. 2 shows a control device 18, in any of the segments, and a detonator 14 in the segment. The control device includes a voltage modulator 22 while the detonator includes a current modulator 24.

Communication from a respective controller 12 to each of the detonators 14, in a given segment, is effected by using the voltage modulator 22 to modulate the relevant signals, thereby to produce output signals which typically have magnitudes of the order of several volts. Communication in the reverse direction i.e. from each detonator to the controller 12, is effected by using the respective current modulator 24 to modulate the return signals.

Figure 3:
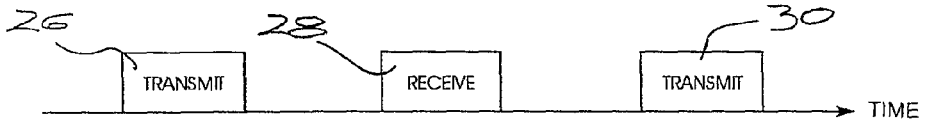
FIG. 3 illustrates, on a time line, transmit and receive sequences during communication in the detonator system.

The aforementioned sequence of communication events is depicted in FIG. 3 which illustrates a transmit phase or packet of signals 26, directed to the various detonators in a segment, followed by a receive phase or packet of signals 28 from the detonators in the reverse direction followed, if necessary, by a transmit phase 30 to the detonators, and so on. As noted cross-talk problems can arise if a receive phase 28 in one segment overlaps with a transmit phase 26 in an adjacent segment. The invention aims to reduce the likelihood of this occurring.

FIG. 1 illustrates a master clock 40 which can form part of the controller 12. Alternatively a master clock 40A can be included in one of the control devices 18. The master clock is used to ensure that the transitions from voltage modulation to current modulation, at least in adjacent segments 16, are synchronised. The control devices 18 are required to synchronise their respective detonator communication messages with the master clock (40 or 40A) such that a transition from the transmission of voltage modulated signals to the transmission of current modulated signals occurs only on a clock transition or is otherwise synchronised with a clock transition. With the master clock at the controller 12 clock signals are generated and fed to the detonator control devices 18 through a communication channel 42. A similar effect takes place if a master clock 40A is associated with one of the control devices.

As an alternative approach each control device 18 includes a respective clock and the clocks are synchronised so that each control device is thereafter capable of generating its own synchronisation signals without the need to communicate with other devices after the initial synchronisation. The net effect in each case is the same, namely a transition from voltage modulation to current modulation in each segment takes place at the same time. This ensures that there is no overlap between the transmission of a current modulated signal in one segment and the transmission of a voltage modulated signal in another segment.

Another method of synchronising detonator communications is to control the various control devices 18 so that they permit the transmission of the voltage modulated signals in a manner which ensures that these transmissions effectively end at the same time. This can be achieved by the use of a suitable logic controller 46. Thereafter transmission of the current modulated signals can take place in the segments.

In a different technique each control device 18 interrogates the controller 12 to establish whether conditions are such that current modulated signals can be transmitted and, if so, the controller 12 allocates a time slot within which all current modulated signals can be transmitted. This prevents an overlap with the transmission of voltage modulated signals.

In another approach the commands which are to be sent from the controller 12 are identified beforehand. A schedule of commands is constructed under the supervision of the logic control unit 46 which minimises the time which will be taken for the transmission of the commands taking into account the transition criteria between voltage modulation and current modulation. Information on the schedule or the commands is then transmitted to each of the devices 18 which implement the necessary control parameters. With this approach each control device includes a respective clock 40A. These clocks are, of necessity, synchronised beforehand and are accurate.

In a variation of the invention the control devices 18 in each segment are omitted. Instead the controller 12 is able to communicate, in parallel, with the detonators in each segment via a dedicated channel uniquely associated with each respective segment. The controller exerts a single control function which ensures that the detonators do not transmit current modulated signals to the controller until all of the voltage modulated signals have been transmitted by the controller to the various detonators.

Figure 4:
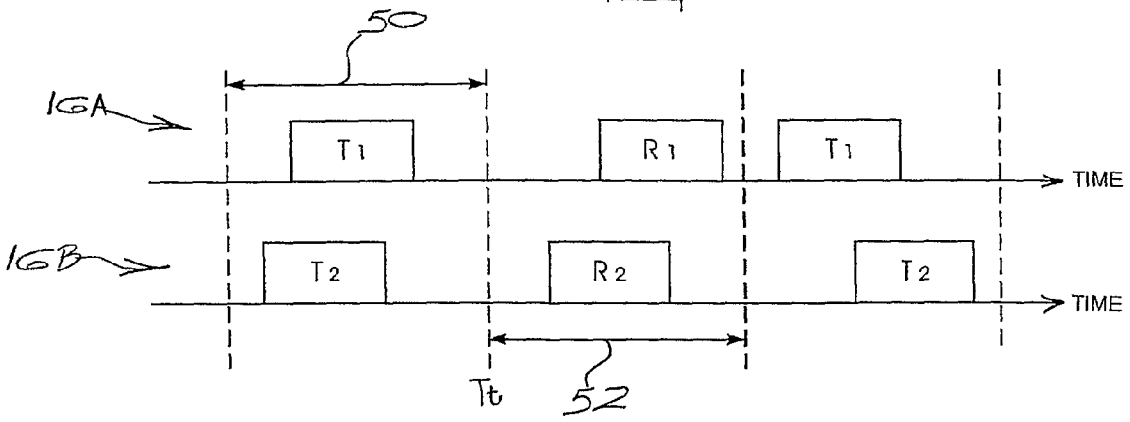
FIG. 4 illustrates the effect of adopting a communication synchronisation technique, according to the invention, in a detonator system.

FIG. 4 is a schematic representation of the effect of synchronising the transitions between voltage modulated signals and current modulated signals in two segments. An upper time line represents transmission and receiving phases designated T1 and R1 respectively for a first segment 16A. A lower time line has a similar representation of transmission and receiving phases T2 and R2 for a segment 16B. During a first time period 50 only voltage modulated signals can be transmitted to the segments. Thereafter, during a period 52, only current modulated signals can be transmitted from the detonators to the controller 12. The transition from the period 50 to the period 52 occurs at a time Tt. It is evident from this graphical depiction that it is not possible for current modulated signals to be transmitted while voltage modulated signals are being transmitted.

The invention claimed is:

1. A detonator system comprising:

a plurality of segments, each segment including a plurality of detonators, each of the plurality of detonators including a current modulator;

a plurality of control devices that are respectively associated with each segment of the plurality of segments, each of the plurality of control devices including a respective voltage modulator;

a plurality of communication channels, each communication channel being uniquely associated with a respective segment of the plurality of segments;

a master controller connected to the plurality of communication channels, wherein a signal from the master controller transmitted to each of the plurality of detonators in the respective segment is modulated by the voltage modulator of the control device associated with the respective segment, and the voltage modulated signals are then transmitted in parallel through the plurality of communication channels to one or more of the plurality of detonators in each of the plurality of segments, further wherein a signal from at least one detonator in each of the plurality of segments is modulated by the current modulator in the detonator and the current modulated signals are then transmitted in parallel through the plurality of communication channels to the control device and then to the master controller; and a synchroniser which prevents the transmission of the voltage modulated signals in at least one segment simultaneously with the transmission of the current modulation signals in at least one other segment.

2. A detonator system according to claim 1 wherein all the segments are synchronised so that the transmission of voltage modulated signals in any segment does not occur at the same time as the transmission of current modulated signals in any of the other segments.

3. A detonator system according to claim 2 wherein the synchroniser is a compound arrangement made up of a plurality of devices located at different respective positions.

4. A detonator system according to claim 2 wherein the synchroniser is a master clock associated with the master controller.

5. A detonator device according to claim 1 which includes a master clock which is operable to ensure that, within each of the plurality of segments, the transition of a period within which voltage modulated signals is transmitted to a period within which the current modulated signals are transmitted occurs only at a defined time determined by the master clock.

6. A detonator system according to claim 1 wherein the control device which controls the transmission of the voltage modulated signals in each of the plurality of segments thereby to ensure that transmission of current modulated signals, on all of the plurality of segments, only takes place when the voltage modulated signals on all of the plurality of segments cease.

7. A detonator system according to claim 1 wherein the control device of each of the plurality of segments communicates with the master controller and the master controller allocates a time slot, per segment, for the transmission of current modulated signals from that segment to the master controller.

8. A detonator system according to claim 1 wherein commands contained in the voltage modulated signals are identified and a fixed time slot is allocated for the transmission of the voltage modulated signals, which contain the identified commands, to each of the plurality of segments.

9. A detonator system according to claim 8 wherein after the expiry of the time slot the transmission of the current modulated signals is permitted.

10. A method of reducing cross-talk in a detonator system which has a master controller, a plurality of segments each including a plurality of detonators, and a plurality of communication channels, each communication channel being uniquely associated with a segment of the plurality of segments, the method comprising the steps of:

originating a plurality of first signals at the master controller;

voltage modulating the plurality of first signals;

transmitting in parallel on the plurality of communication channels the voltage modulated first signals to at least one detonator in each of the plurality of segments;

transmitting the respective current modulated second signals in parallel on the plurality of communication channels to the master controller; and synchronising the transmission of the plurality of voltage modulated first signals and the plurality of current modulated second signals so that the plurality of voltage modulated first signals are not transmitted while the plurality of current modulated second signals are being transmitted.

* * * * *